US005903210A

United States Patent [19]

Hofsäss

[11] Patent Number: 5,903,210

[45] Date of Patent: May 11, 1999

[54] TEMPERATURE-DEPENDENT SWITCH HAVING AN ELECTRICALLY CONDUCTIVE SPRING DISK WITH INTEGRAL MOVABLE CONTACT

[76] Inventor: Marcel Hofsäss, Bodelschwinghstr. 36, D-75179 Pforzheim, Germany

[21] Appl. No.: 08/760,862

[22] Filed: Dec. 5, 1996

[30] Foreign Application Priority Data

Dec. 9, 1995 [DE] Germany ..... 195 46 004

[51] Int. Cl.[6] ..... H01H 37/74

[52] U.S. Cl. ..... 337/342; 337/333; 337/380

[58] Field of Search ..... 337/342, 343, 337/365, 375, 377, 379, 380, 388, 333, 329; 200/83 P, 513, 275

[56] References Cited

U.S. PATENT DOCUMENTS

| | | | |
|---|---|---|---|
| 4,492,946 | 1/1985 | Loescher . | |
| 4,894,634 | 1/1990 | Nezuka et al. | 337/343 |
| 5,014,035 | 5/1991 | Hamada et al. | 337/365 X |
| 5,121,095 | 6/1992 | Ubukata et al. | 337/365 |
| 5,309,131 | 5/1994 | Hofsass et al. | 337/365 X |

FOREIGN PATENT DOCUMENTS

| | | |
|---|---|---|
| 1433185 | 2/1966 | France . |
| 2917482 | 11/1982 | Germany . |
| 3319225 | 11/1984 | Germany . |
| 3319227 | 3/1988 | Germany . |
| 3710672 | 10/1988 | Germany . |
| 4142716 | 6/1993 | Germany . |
| 4337141 | 5/1995 | Germany . |
| 2 275 823 | 9/1994 | United Kingdom . |

*Primary Examiner*—Leo P. Picard
*Assistant Examiner*—Jayprakash N. Gandhi
*Attorney, Agent, or Firm*—Harness, Dickey & Pierce, P.L.C.

[57] ABSTRACT

A temperature-dependent switch has first and second external terminals arranged at an electrically conductive lower housing part and an insulating cover part, respectively. Within said lower housing part there is arranged a temperature-dependent switching mechanism having a bimetallic snap disk and an electrically conductive spring disk carrying a movable contact element that is configured integrally with and as a dome on the spring element. Depending on the temperature of said bimetallic snap disk said spring element is in electrical contact with said first terminal and via said movable contact element with said second terminal.

5 Claims, 1 Drawing Sheet

TEMPERATURE-DEPENDENT SWITCH HAVING AN ELECTRICALLY CONDUCTIVE SPRING DISK WITH INTEGRAL MOVABLE CONTACT

BACKGROUND OF THE INVENTION

1. Field of the Invention

The present invention relates to a switch having a switching mechanism that switches in the presence of overtemperature, for opening and closing a circuit that can be connected to external terminals of the switch, the switching mechanism comprising an electrically conductive spring element which, as a function of the temperature of a bimetallic element, operates against the latter and in the idle position is electrically connected to one external terminal, and carries a movable contact which, as a function of the temperature of the bimetallic element, is in contact with a fixed contact that is electrically connected to the other external terminal.

2. Description of Related Art

A temperature-dependent switch of this kind is known from DE 29 17 482 C2.

The known switch serves to monitor the temperature of a device. To this end, it is connected via its external terminals in series with the device being monitored, and is arranged so that the temperature of the device being monitored influences the temperature of the bimetallic element. If the switching temperature is exceeded, the switching mechanism opens the connection between the two external terminals, and the electric circuit passing through it is interrupted. When the temperature drops, the electric circuit is closed again, although this need not absolutely be the case; bistable temperature-dependent switches are also known.

The known switch has a housing consisting of an electrically conductive lower housing part and an electrically conductive cover part which caps the latter, an insulating film being provided for insulation between the lower housing part and cover part. An inwardly projecting region on the cover part is configured as a fixed contact. The switching mechanism has a spring disk on which the movable contact, which comes into contact with the fixed contact, is mounted by means of a crimped rim. A bimetallic snap disk, which below the switching temperature is received unconstrainedly in the housing, is slipped over the spring disk. Current flow occurs via the conductive cover part, the contact, the spring disk, and the conductive lower housing part in which the spring disk is supported. When the switching temperature is exceeded, the bimetallic snap disk snaps over and pushes the spring disk, with its contact, away from the cover part.

Mechanical assembly of the known switch is laborious in particular because the contact must be mounted by means of the crimped rim on the spring disk.

A comparable switch is known from DE 37 10 672 A1. This so-called temperature controller is configured to be self-holding, i.e. it comprises a heating resistor, connected in parallel with a bimetallic switching mechanism, which when the switching mechanism is open is connected in series between the external terminals, and heats up as a result of the current flowing through to the point that it keeps the bimetallic switching mechanism above its switching temperature, so that it does not return back to the original state. The high-ohmic resistor is integrated into the cover part, which consists of either insulating material or an electrically conductive resistor material.

In the case of this switch the movable contact is placed loose into the spring disk, and clamped between the spring disk and the bimetallic snap disk by means of a projecting annular shoulder.

The disadvantage here is that during final assembly, which is generally performed manually by semi-skilled personnel, first the spring disk must be placed into the lower housing part, then the contact part into the spring disk, and lastly the bimetallic snap disk must be placed over the contact part. This procedure is very time-consuming, and admits of only limited automation. Moreover it can cause the contact part to slide during assembly, thus increasing rejects.

In order to eliminate these disadvantages, it has already been proposed, in DE 43 37 141 A1, to weld the contact onto the spring disk.

Although this eliminates the aforementioned disadvantages in terms of final assembly of the switch, it is still necessary, as in the case of the switch from DE 29 17 482 C2 mentioned earlier, to mount the contact onto the spring disk by means of additional actions.

In all the known switches discussed so far, the movable contact is a part to be turned that can be manufactured only with corresponding material and production outlay, so that it contributes significantly to the total cost of the known switch.

SUMMARY OF THE INVENTION

Proceeding from this, the object of the present invention is to improve the switch mentioned at the outset in such a way that it has a simple and economical construction and can be easily assembled.

According to the invention, this object is achieved by the fact that the movable contact is configured integrally with the spring element.

The underlying object of the invention is completely achieved in this manner. Specifically, the inventor of the present application has recognized that, surprisingly, it is not in fact necessary to use a turned part as the movable contact element, but rather that this movable contact can also be fabricated from the material of the spring disk. Previously it had always been assumed in the prior art that the movable contact had to be a separate contact element, which preferably rested loose in the spring disk but at most could be mounted later on, by means of suitable measures, onto the spring disk. This was intended to ensure that the resilient properties of the spring disk could be produced independently of the solid contact element. The inventor has now recognized, however, that this is based on a prejudgment, and that the resilient properties of the spring element on which the contact is integrally configured are entirely sufficient for the intended applications. The inventor has further recognized that it is also not necessary to use a turned part as the movable contact, but rather that the contact resistance and conductivity are entirely sufficient even in the case of a movable contact constituted from the material of the spring element.

The new switch thus has a whole series of advantages. Firstly, production costs are reduced due to the lower number of components that are in the new switch, since the new spring element replaces, so to speak, the previous contact element and the previous spring element. In addition, it is no longer necessary to mount the contact element onto the spring disk before or during final assembly of the switch, so that this production step is superfluous. All in all, therefore, not only are component costs, costs for inventory, and the number of components reduced, but also the time required for final assembly, which now can also be accomplished automatically, thus avoiding further rejects. A further advantage lies in the fact that the number of contact resistance points, i.e. the number of required contact regions, is reduced to the absolute minimum, since the contact resistance between the contact element used in the prior art and the spring disk is omitted. The quality of the overall contact resistance of the switch is thus improved, and problems of material selection with regard to aging are also solved. Since the contact disk and spring element are now made from the same material, problems (such as corrosion) that occur with electrical contacts between unlike metals are also eliminated.

In one embodiment it is preferred if the movable contact is configured as a dome on the spring element, and if the bimetallic element is a bimetallic snap disk that is slipped over the dome.

The advantage here is that no laborious positioning operations are necessary when assembling the new switch; the bimetallic snap disk centers itself, so to speak, automatically on the dome.

It is preferred in this connection if the dome has an insulating layer in the contact region with the bimetallic snap disk.

The advantage here is that current is prevented from passing through the bimetallic snap disk when the new switch is in any switching state. This prevents the flow of current through the switching mechanism from heating the bimetallic snap disk and thus causing a shift in switching temperature.

In general it is preferred if the dome has a resistive layer in the contact region with the fixed contact.

The advantage here is that with the new switch in the closed position, the resistor constituted by this resistive layer is connected in series between the external terminals of the switch, and heats up because of the operating current of the device being protected as it flows through. This heating can either be used to adjust the switching temperature of the bimetallic switching mechanism by means of a kind of preheating; or by means of this resistor it is also possible to institute a current sensitivity that is known as a feature per se from the prior art. Specifically, if the operating current of the load that flows through the switching mechanism exceeds a preselected value, the heating of the resistor becomes so great that the bimetallic snap disk switches the switching mechanism over and interrupts the circuit. The arrangement of this resistor on the dome of the spring disk offers particular advantages, since complex assembly of the heating resistor, which is necessary in the case of the prior art, can be omitted here. The spring element is, so to speak, supplied with a preassembled resistor, so that despite the current-sensitivity property, no further assembly steps result. The resistive layer can be applied, for example, by sputtering, with a thick-layer or thin-layer technique, or by means of other suitable methods.

Further advantages are evident from the description and the attached drawings.

It is understood that the features mentioned above and those yet to be explained below can be used not only in the respective combinations indicated, but also in other combinations or in isolation, without leaving the context of the present invention.

The invention is shown in the drawings, and will be explained further in the description below.

BRIEF DESCRIPTION OF THE DRAWING

The single FIGURE shows a schematic longitudinal section through the new switch.

DETAILED DESCRIPTION OF A PREFERRED EMBODIMENT

Figure 1:
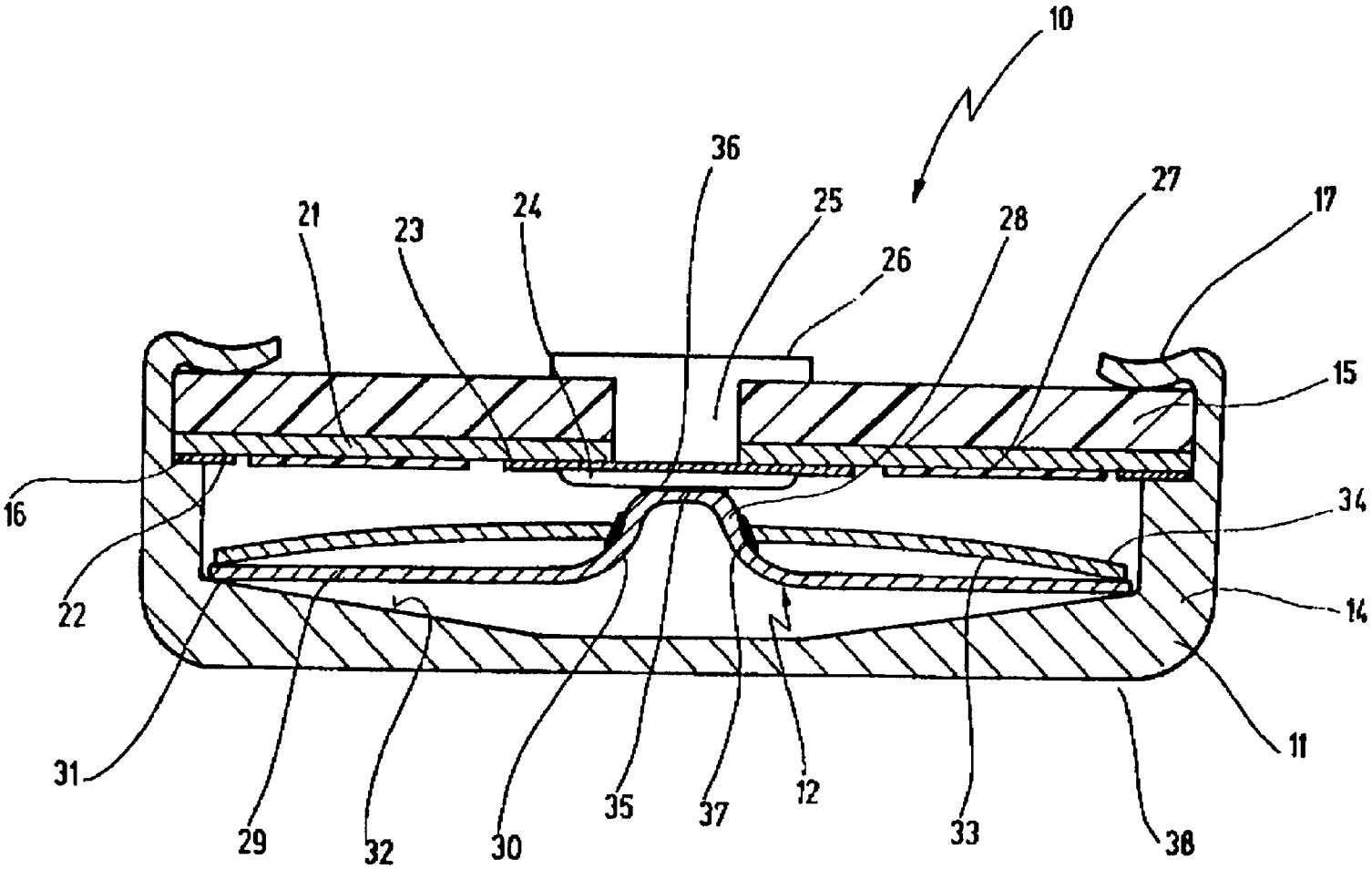

In the single FIGURE, 10 shows a switch which comprises a housing 11 in which a bimetallic switching mechanism 12 is arranged.

Housing 11 comprises an electrically conductive lower housing part 14 and a cover part 15, made of insulating material, that is supported on a shoulder 16 of lower housing part 14. Cover part 15 is pressed onto shoulder 16 by means of a crimped rim 17 of lower housing part 14, resulting in a so-called encapsulated switch 10.

Provided on the inside of cover part 15 is a heating resistor 21 that is in electrical contact with shoulder 16 via an outer contact ring 22. Heating resistor 21 is connected via an inner contact ring to a fixed contact 24 that passes, in the form of a rivet 25, through cover part 15 and constitutes a first external terminal 26 of switch 10. An insulating layer 27 is provided on heating resistor 21 between the two contact rings 22, 23.

Associated with fixed contact 24 is a movable contact 28 which is an integral part of a spring disk 29 and has the shape of a dome 30. The spring disk, made of electrically conductive material, is supported at its rim 31 on bottom 32 of lower housing part 14. A bimetallic snap disk 33, which has a rim 34, is slipped over dome 30.

In the contact region with fixed contact 24, dome 30 has a resistive layer 35 that constitutes a heating resistor 36. In addition, an insulating layer 27 is provided on dome 30 in the contact region with bimetallic snap disk 33, so that no electrical connection exists in this region between spring disk 30 and bimetallic snap disk 33.

Lastly, it should be mentioned that a second external terminal 38 of switch 10 is constituted by lower housing part 14 itself.

In the switch position shown in FIG. 1, bimetallic snap disk 33 is below its response temperature, so that spring disk 29 provides electrical contact between lower housing part 14 and fixed contact 24 and thus external terminal 26. Heating resistor 36 is connected in series between external terminals 25 and 38, so that the current of a device to be connected to external terminals 26, 38 flows through it. Heating resistor 21 is connected in parallel with bimetallic switching mechanism 12, and in the switch position shown in FIG. 1 is shorted out by the series circuit consisting of the bimetallic switching mechanism and heating resistor 36. The resistance values of heating resistors 36 and 21 are selected so that the operating current of the device being protected flows substantially through heating resistor 36.

When the temperature of bimetallic snap disk 33 then rises above the response temperature, as a result of an elevated temperature of the device that is thermally connected to the new switch 10 or because of excessive current flow through heating resistor 36 and the heating associated therewith, the bimetallic snap disk suddenly snaps over, braces itself with its rim 34 against insulating layer 27, and thereby lifts dome 30 away from fixed contact 24 against the force of spring disk 29. Current now flows through heating resistor 21, which develops sufficient heat to hold the bimetallic switching mechanism in the open state. Even without insulating layer 27, no current would flow through bimetallic snap disk 33, since the latter is insulated with respect to spring disk 29 by means of insulating layer 37. In the state shown in FIG. 1, insulating layer 37 further ensures that even when switching mechanism 12 is in the idle position, no partial current can flow through bimetallic snap disk 33 and thereby modify the switching temperature.

Of course the new switch can also be constructed without heating resistors 21 and/or 36; switch 10 is then used solely for temperature monitoring.

I claim:

1. A temperature-dependent switch, comprising:

first and second external terminals;

a temperature-dependent switching mechanism for interconnecting said first and second terminals;

the switching mechanism including a bimetallic snap disk and an electrically conductive spring element carrying a movable contact element that is configured integrally with and as a dome on the spring element, said bimetallic snap disk being located over the dome, wherein depending on the temperature of said bimetallic snap disk said spring element is in electrical contact with said first terminal and via said movable contact element with said second terminal.

2. The switch of claim 1, wherein the dome has an insulating layer in a contact region with the bimetallic snap disk.

3. The switch of claim 1, wherein the dome has a resistive layer in a contact region with the fixed contact.

4. The switch of claim 1, comprising a housing having an electrically conductive lower housing part in which the spring element is supported, and a cover part which caps the lower housing part and carries a fixed contact associated with said movable contact element.

5. A temperature-dependent switch, comprising:

first and second external terminals;

a temperature-dependent switching mechanism for interconnecting said first and second terminals;

the switching mechanism including a bimetallic element and an electrically conductive spring element carrying a movable contact element that is configured integrally with and as a dome on the spring element, the dome having a resistive layer in a contact region with said fixed contact between the movable contact element and the fixed contact;

wherein depending on the temperature of said bimetallic element said spring element is in electrical contact with said first terminal and via said movable contact element with said second terminal.

* * * * *